United States Patent [19]

Newman

[11] Patent Number: 4,671,509

[45] Date of Patent: Jun. 9, 1987

[54] TENNIS NET CENTER STRAP

[76] Inventor: Clarence R. Newman, 815 Boyou River, Houston, Tex. 77079

[21] Appl. No.: 909,236

[22] Filed: Sep. 19, 1986

[51] Int. Cl.[4] ..... A63B 61/00

[52] U.S. Cl. ..... 273/29 BA

[58] Field of Search ..... 273/29 BA, 29 B, 29 R, 273/411

[56] References Cited

U.S. PATENT DOCUMENTS

| | | | |
|---|---|---|---|
| 1,534,447 | 4/1925 | Hardy | 273/29 BA |
| 3,549,146 | 12/1970 | Davis | 273/29 BA |
| 4,247,099 | 1/1981 | Pandak | 273/29 BA |

FOREIGN PATENT DOCUMENTS

| | | | |
|---|---|---|---|
| 190006 | 12/1922 | United Kingdom | 273/29 BA |

OTHER PUBLICATIONS

Quick-Set, Inc, 10/1980.

*Primary Examiner*—Richard C. Pinkham
*Assistant Examiner*—T. Brown
*Attorney, Agent, or Firm*—Jack W. Hayden

[57] ABSTRACT

A tennis court net center strap of a single elongated strip of material has a loop therein about midway to provide first and second strip portions with a loop end and free end respectively. The second portion has a Velcro fastener or lock of hook and loop surfaces and when the second portion is extended through a connection on the loop end with the tennis net therebetween, the second portion is doubled back on itself to lock the strap around the net. An additional lock secures the free end of the second portion to the second portion so the lock is positioned between the connection and additional lock.

8 Claims, 3 Drawing Figures

TENNIS NET CENTER STRAP

BACKGROUND OF THE INVENTION

A tennis court is divided across the middle by a net suspended from a suitable cord such as metal cable the ends of which cord pass over the tops of two posts, one on each side of the court. The net is extended fully so that it fills completely the space between the two posts and the height of the net is 3 feet at the center where it is held taut by a center strap not more than 2 inches wide and white in color.

Numerous devices and articles of manufacture have been proposed for use on center straps on tennis courts in the past one of which is a strap produced in accordance with U.S. Pat. No. 4,247,099 to Pandak. The Pandak device is a single length strap having a fastener known as Velcro adjacent each strap end. A snap hook, or other suitable tie down, disposed between the two ends of the strap connects the strap to a mount in the tennis court surface. The strap encloses and extends over the tennis net and the loop and hook surfaces forming the fastener are engaged to attempt to secure and maintain the tennis net at the desired height. While the device in Pandak is relatively simple in its construction and easy to arrange and install, it has been found that it does not have the holding power necessary to maintain the net at the required 3 feet over an extended period of time. This may be due to the fact that the loop and hook surfaces of the Velcro fastener become worn or stretched. Also, the shock of the tennis ball hitting the net may tend to jar the surfaces and tend to disengage them. In addition, water from rain or other sources may cause the loop and hook surfaces to loosen with the result that the net cannot be maintained at the desired constant height over an extended period of time, or when the net is slackened or removed for court surface treatment.

A second device has been in use in an attempt to overcome the above difficulties and includes a single elongated strap having first and second ends. One end is free while the other end has attached thereto a buckle with a serrated surface thereon. A snap hook is secured to that same end spaced from the end buckle. A toothed buckle with a serrated surface is slidably supported on the strap between the fixed snap hook and the fixed buckle. When the snap hook is secured to the court surface the free end is passed over the net, and extends down and through to the buckles. This device provides better holding power than the Pandak system but suffers from the disadvantage that the slidably arranged buckle may eventually work its way toward to and/or abut againt the fixed buckle making adjustment practically impossible without substantial effort.

SUMMARY OF THE INVENTION

This invention relates to a tennis net center strap that is simple and easy to position and adjust to the correct height. It provides a double locking arrangement that remains engaged over an extended period of time and without necessarily requiring adjustment when placed back in position after the net has been lowered or removed for conditioning of the tennis court surface, or for any other reason. The strap of the present invention overcomes the difficulties and the deficiencies of the prior art devices heretofore proposed and in use.

This invention also relates to a tennis net center strap having an elongated strip of material with a loop therein approximately midway of the length of the strip forming two portions, one with a free end and one with a loop end. The loop is adapted to receive means such as a snap hook to engage with an anchor in the court surface. A Velcro fastener or lock means is provided on the strip portions with the free end, said fastener, lock means including a hook surface and a loop surface which may be spaced one from the other on the same side of the strip and secured thereto.

Additional lock means is slidably arranged on the strip between the loop and the Velcro fastener, and connecting means is secured to the loop end of the strip.

The strip is constructed or formed of any suitable material such as, by way of example only, synthetic fabric selected from the group consisting of polyester, polyethylene and nylon. The connecting means may be a buckle received within the loop end. The loop end of the strip includes a reinforcing layer for extending over the top of the net, and stitching may be employed to secure the fastener surfaces to the strip, to form the loop, the loop end in the strip of material, and further to secure the strip of material and the reinforcing layer together. The loop end of the strip along with the connecting means which may be a buckle secured with the loop end is the portion of the strip of material that is preferably to be passed over the top of the tennis net when in use; however, either portion of the strip of material may be extended over the top of the net. The net is held taut by the Velcro fastener with the connecting buckle thereabove and with the additional lock means therebelow, in order to insure that the net is held fixed and taut over an extended period of time. If the net is lowered or removed, the present invention enables the net to be repositioned on the court at the proper height with minimum and possibly no adjustment of the center net strap.

DESCRIPTION OF THE PREFERRED EMBODIMENT

Figure 1:
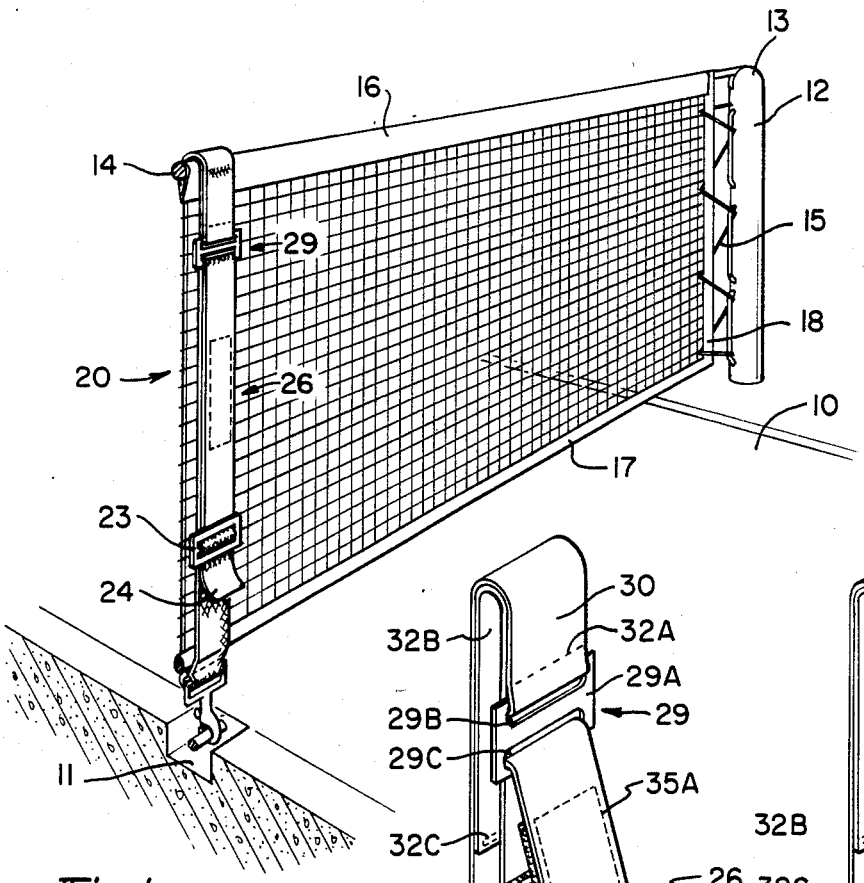
FIG. 1 is a pictorial representation partly in cross-section of a portion of a tennis court and illustrating the center strap of the present invention in its arrangement with respect to the center section of the net.

In FIG. 1, a portion of a tennis court is illustrated with a playing surface 10 including an anchor 11 of any suitable type positioned in the center of the court playing surface 10, for receiving and anchoring the tennis net center strap 20. The strap 20 is to secure and maintain the tennis net 19 at a predetermined height and taut. A net post 12 is provided at each end of the net 19 and one post is provided with a windlass 13 for controlling and maintaining tension in the net cord or cable 14. Side lacing 15 may be employed to secure net 19 to the net posts 12, and a covering or strip of material forming the net band 16 provides a covering for cable 14 as well as forming an integral part of the net itself. The net 19 further conventionally includes a bottom tape 17 and a side tape 18.

In FIG. 1, the strap 20 of the present invention can be seen at the middle of the net 19 as required, and the remaining half section of the net and court have not been illustrated in the interest of simplicity.

Figure 2:
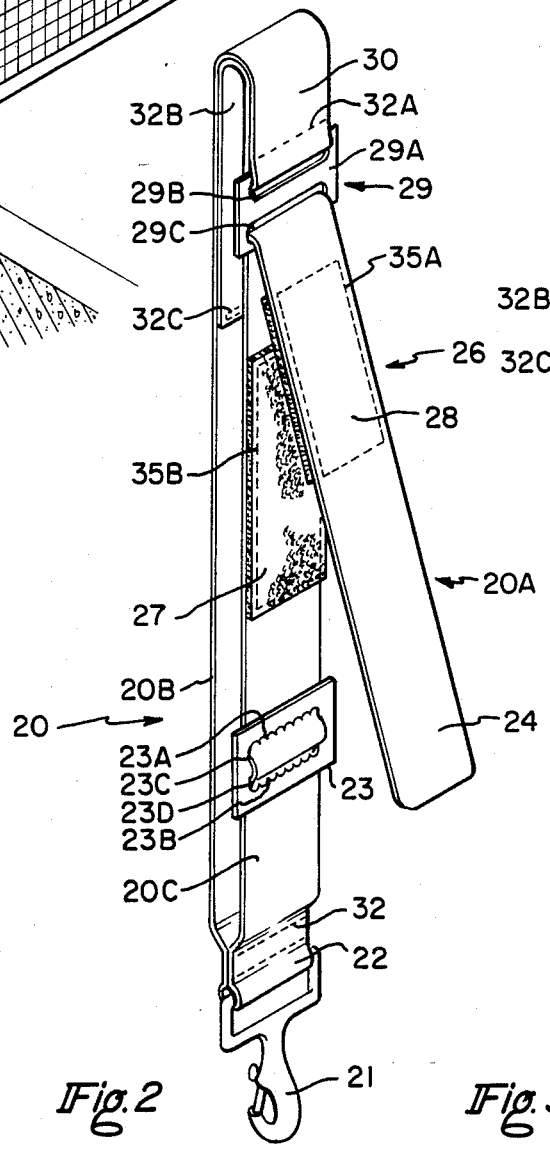
FIG. 2 is a pictorial representation of the center strap only of the present invention with the strap being shown in the initial stage of assembly to surround, or enclose the net and passed over the top thereof.

FIG. 2 shows the strap 20 of the present invention including a strip 20A of elongated material rectangular in shape. The strip 20A is of any suitable material preferably of polyester, nylon or polyethylene.

A loop 22 is formed in the strip 20A by any suitable means such as by stitching 32 which secures a portion of the strip 20A together. The loop 22 is adapted for receiving any suitable means such as snap hook 21 to engage the anchor 11 in the court surface to position the strip 20A and aid in maintaining it in the center of the net. The hook 21 is positioned on the strip of material before the loop 22 is formed by stitching.

The loop 22 is formed between the ends of the strip of material 20A and is preferably about midway of the strip to form it into a first portion 20B and a second portion 20C. The first portion 20B has a loop end 30 and the second portion 20C has what may be termed a free end 24.

The loop end 30 receives connecting means 29, such as the buckle 29A which has slot openings 29B and 29C as shown. The end of first material portion 20B extends through opening or slot 29B and is doubled or folded back as shown at 32B a substantial extent, and stitched as shown at 32A adjacent buckle means 29A and at the end of the folded back part 32B as shown at 32C. The folded back part 32B forms a reinforcing layer that extends over the top of the net when the first portion is extended over the top of the net 19. Since it is stitched at 32A and 32C, it forms a separate layer and if it should wear or break, the center strap will remain in position since the remainder of the first portion 20B is stitched at 32A adjacent the buckle means 29A.

Additional lock means or retaining means of any suitable form such as buckle means 23 is slidably positionable along the second portion 20C between the loop 22 and the Velcro fastener means referred to generally at 26. The Velcro fastener or lock means 26 has hook surface 27 and loop surface 28 carried by the second strip portion between the buckle means 23 and the free end 24. The hook and loop surfaces 27, 28 may be formed on separate material and secured to the second portion 20C by any suitable means such as stitching or the like as represented at 35B and 35A respectively.

After one of the portions of strip material have been passed over the top of the tennis net, the free end 24 of the second portion 20C is passed or extended through the slot 29C in the connecting means 29A and then doubled back on itself to enable the hook and loop surfaces 27 and 28 to be pressed together for locking engagement. This provides a lock means to assist in locking the tennis net strap in position about the tennis net, and the free end 24 may then be engaged with the buckle 23 which provides an additional lock means to further aid in maintaining the tennis net strap at a desired position over an extended period of time.

Figure 3:
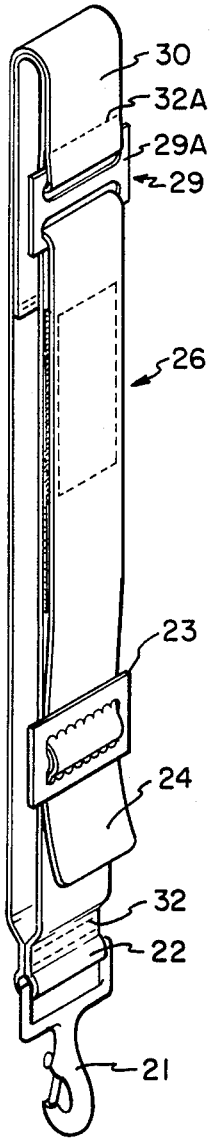
FIG. 3 is a view similar to FIG. 2 but with the center strap being shown in its final arranged relationship, with the tennis net being removed for purposes of clarity.

The buckle means 23 includes serrated surfaces 23A and 23B formed along the slots 23C and 23D respectively in the buckle means 23 for grasping or locking with the material forming the second portion as illustrated in FIG. 3.

To position the center strap of the present invention for use, the strip of material 20A is positioned so that one portion thereof is on one side of the tennis net and the other portion 20C is on the other side of the tennis net to enclose the tennis net as shown in FIG. 1. The snap hook 21 is engaged with the anchor 11 and either one of the portions is passed over the top of the net. Preferably, the first portion 20B and its loop end 30 is the portion which is passed over the top of the net, but if desired the first portion may be made shorter so that the second portion 20C is the portion that passes over the net.

After one of the portions has been passed over the top of the net, the free end 24 of the second portion 20C is passed through the slot 29C of buckle 29A and then doubled back on itself so that the hook and loop surfaces 27 and 28 may be engaged to lock the strap about the net at a predetermined height.

To further lock the strap at the desired position, the free end 24 of the second portion 20C is passed through the slots 23C, 23D of buckle 23 to further secure the net strap in position.

This position is demonstrated in FIGS. 1 and 3 of the drawings. After the tennis net has been adjusted to its predetermined height and the strap positioned as stated, it will be noted that the buckle 29 is on one side of the engaged surfaces 27, 28 and the buckle 23 is on the other side thereof to aid in maintaining surfaces 27, 28 engaged. The surfaces 27, 28 along with the arrangement of the buckle 23 and its connection with the second portion below the surfaces 27, 28 provide a double lock arrangement to aid in maintaining the strap at the predetermined adjusted position over an extended period of time, even though the net may be subsequently lowered or removed for court surface preparation.

The foregoing disclosure of the invention are illustrative and explanatory thereof, and various changes in size, shape and materials as well as in the details of the illustrated construction may be made without departing from the spirit of the invention.

What is claimed is:

1. A tennis net center strap for securing with an anchor in a tennis court surface whereby the net may be enclosed by the strap passing over the top of the net comprising:

an elongated strip of material with a loop formed therein to divide the strip of material into a first portion terminating in a loop end and a second portion extending from the loop to a face end of the strip of material whereby the tennis net may be positioned between said first and second portions;

said loop having a fastener to connect the tennis net center strap to the court surface anchor so that one of said portions may be extended over the top of the tennis net;

connecting means attached to said first portion loop end for receiving the second portion therethrough after one of said portions is extended over the top of the tennis net to position the center strap around the tennis net;

lock means attached intermediate the ends of said second portion for locking said second portion after said second portion is received through said connecting means to thereby maintain the center strap around the tennis net and to maintain the tennis net at a predetermined height;

said lock means including a hook surface and a loop surface on said strip second portion which surfaces are lockably engagable after said second portion is extended through said connecting means and folded back on itself; and retaining means on said second portion to retain said lock means engaged, said retaining comprising means for receiving the free end of said second portion after said lock means surfaces are engaged, said retaining means being adjustably positioned on said second portion between said lock means and the loop and having a serrated surface lockably engagable with said second portion free end between said lock means and the loop.

2. The tennis net center strap of claim 1 wherein the portion extending over the top of the tennis net is said first portion.

3. The tennis net center strap of claim 2 wherein said first portion is folded back upon itself to form a reinforcing layer for extending over the top of the net.

4. The tennis net center strap of claim 3 wherein stitching is employed to secure said hook and loop surfaces to the strip, and to form the loop and the loop end in the strip, and further to secure said folded back portion of said first portion to said first portion.

5. A tennis net center strap comprising an elongated strip of material having a free end and a loop end, lock means comprising a hook surface and a loop surface adjacent said free end, said surfaces being spaced one from the other on the same side of the strip and secured thereto, a loop formed in the strip between the free end and the loop end thereof and said loop being spaced approximately midway of the length of the strip, a snap hook secured with said loop for attaching said strip to a court surface anchor, additional lock means including buckle means slidably arranged on the strip between said loop and said lock means and having serrated surfaces thereon, and connecting means secured to the loop end of the strip for receiving said free end.

6. The tennis net strap of claim 5 wherein the loop end of the strip along with said connecting means secured thereto are adapted to be passed over the top of a tennis net when in use, whereby said free end of the strip may be extended through said connecting means, said strip then being folded back upon itself to engage said lock means and then extended through said additional lock means to be secured with said serrated surfaces thereon, said connecting means being positioned above said lock means and said additional lock means to engage and hold the tennis net strap fixed at a desired position.

7. A tennis net center strap comprising an elongated strip of material having a free end and a loop end, lock means comprising a hook surface and a loop surface secured adjacent the free end of the strip, said hook surface and a loop surface being spaced one from the other on the same side of the strip and secured thereto, a loop formed in the strip between the free end of the strip and the loop end thereof, said loop being positioned approximately midway of the strip, a snap hook secured to said loop for attaching said strap to a court surface anchor, additional lock means arranged on the strip between said loop and said lock means for receiving said free end, and a connecting means secured to said loop end of the strip for receiving said free end and engaging said strip between said hook and loop surfaces.

8. The tennis net center strap of claim 1 wherein said connecting means is a buckle, and wherein said additional lock means is a buckle.

* * * * *

UNITED STATES PATENT AND TRADEMARK OFFICE

CERTIFICATE OF CORRECTION

PATENT NO. : 4,671,509

DATED : June 9, 1987

INVENTOR(S) : Clarence R. Newman

It is certified that error appears in the above-identified patent and that said Letters Patent are hereby corrected as shown below:

Column 4, line 46, "face" should be --free--.

Signed and Sealed this

Tenth Day of November, 1987

*Attest:*

DONALD J. QUIGG

*Attesting Officer*

*Commissioner of Patents and Trademarks*